US007744174B2

(12) United States Patent
Peng et al.

(10) Patent No.: US 7,744,174 B2
(45) Date of Patent: Jun. 29, 2010

(54) LATCH MECHANISM FOR SLIDE RAIL ASSEMBLY

(75) Inventors: Wen-Tang Peng, Taipei Hsien (TW); Mo-Ming Yu, Shenzhen (CN); Kuo-Ming Huang, Taipei Hsien (TW)

(73) Assignees: Hong Fu Jin Precision Industry (Shen Zhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 386 days.

(21) Appl. No.: 11/778,082

(22) Filed: Jul. 16, 2007

(65) Prior Publication Data

US 2008/0141496 A1 Jun. 19, 2008

(30) Foreign Application Priority Data

Dec. 15, 2006 (CN) ..... 2006 1 0201311

(51) Int. Cl.
*A47B 95/00* (2006.01)
*A47B 88/00* (2006.01)

(52) U.S. Cl. ..... 312/333; 312/334.47

(58) Field of Classification Search ..... 312/333, 312/334.44–334.47, 334.7; 384/21
See application file for complete search history.

(56) References Cited

U.S. PATENT DOCUMENTS

| | | | | |
|---|---|---|---|---|
| 6,457,790 | B1 * | 10/2002 | Liang et al. | 312/334.46 |
| 7,357,468 | B2 * | 4/2008 | Hwang et al. | 312/333 |
| 7,413,269 | B2 * | 8/2008 | Chen et al. | 312/333 |
| 2003/0178922 | A1 * | 9/2003 | Chen et al. | 312/334.44 |
| 2004/0174100 | A1 * | 9/2004 | Chen et al. | 312/333 |

* cited by examiner

*Primary Examiner*—Janet M Wilkens
*Assistant Examiner*—Timothy M Ayres
(74) *Attorney, Agent, or Firm*—Frank R. Niranjan

(57) ABSTRACT

A latch mechanism is provided for retaining a slide rail assembly, which includes first and second slide rails. The latch mechanism includes a first latch member pivotably attached to the second slide rail, and a second latch member movably attached to the second slide rail. The first latch member includes a driving portion, an operating portion, and a first stop portion. The second latch member includes a second stop portion and a driven portion. A protrusion extends from the first slide rail capable of being blocked between the first and second stop portion to confine the second slide rail relative to the first slide rail. The operating portion is capable of being pressed to bias the first latch member, such that the driving portion drives the driven portion to bias the second latch member to thereby release the protrusion of the first slide rail from the first and second stop portions.

17 Claims, 7 Drawing Sheets

LATCH MECHANISM FOR SLIDE RAIL ASSEMBLY

BACKGROUND OF THE INVENTION

1. Field of the Invention

The present invention relates to a latch mechanism for a slide rail assembly.

2. Description of Related Art

Slide rails are used in a variety of applications, including business furniture, kitchen drawers, electronic racks, and copiers. One type of slide rail is a telescopic slide rail. Telescopic slide rails often comprise two, three, four or more telescoping members. The shape of a slide rail, and the individual members, are determined by the design. The slides can be frictional, with lubricated members rubbing against each other, or a slide assembly may include roller or ball bearings for easier movement. The members in such assemblies tend to be C-shaped in nature.

A conventional three-section slide rail assembly for a drawer includes a first slide rail (e.g. outer slide rail), a second slide rail (e.g. middle slide rail), and a third slide rail (e.g. inner slide rail). A ball rail is sandwiched between any two of the first slide rail, the second slide rail, and the third slide rail to provide a smooth sliding movement. Moreover, the third slide rail and the second slide rail mount a retaining member and a stop member respectively to prevent the slide rails extending too far. The retaining member is attached to an inner surface of the third slide rail, and provided with an inclined wall. The stop member is mounted to a front end of the second slide rail, and provided with a protrusion. To prevent users from drawing the third slide rail out too far from the second slide rail, the protrusion of the stop member engages with the inclined wall of the retaining member.

Users can draw out a keyboard or a component, which is attached to the third slide rail, for servicing. Although the engagement of the stop member with the inclined wall avoids the release of the third slide rail from the second slide rail by accident, it cannot prevent the third slide rail retracting into the second slide rail too far by careless force of users. Therefore, it is inconvenient to users for operating the slide rail assembly in use.

Consequently, it is required to provide a two-way latch mechanism for a slide rail assembly.

SUMMARY OF THE INVENTION

In one preferred embodiment, a latch mechanism is provided for retaining a slide rail assembly, which includes first and second slide rails. The latch mechanism includes a first latch member pivotably attached to the second slide rail, and a second latch member movably attached to the second slide rail. The first latch member includes a driving portion, an operating portion, and a first stop portion. The second latch member includes a second stop portion and a driven portion. A protrusion extends from the first slide rail capable of being blocked between the first and second stop portion to confine the second slide rail relative to the first slide rail. The operating portion is capable of being pressed to bias the first latch member, such that the driving portion drives the driven portion to bias the second latch member to thereby release the protrusion of the first slide rail from the first and second stop portions.

Other advantages and novel features of the present invention will become more apparent from the following detailed description of preferred embodiment when taken in conjunction with the accompanying drawings, in which:

DETAILED DESCRIPTION OF THE INVENTION

Figure 1:
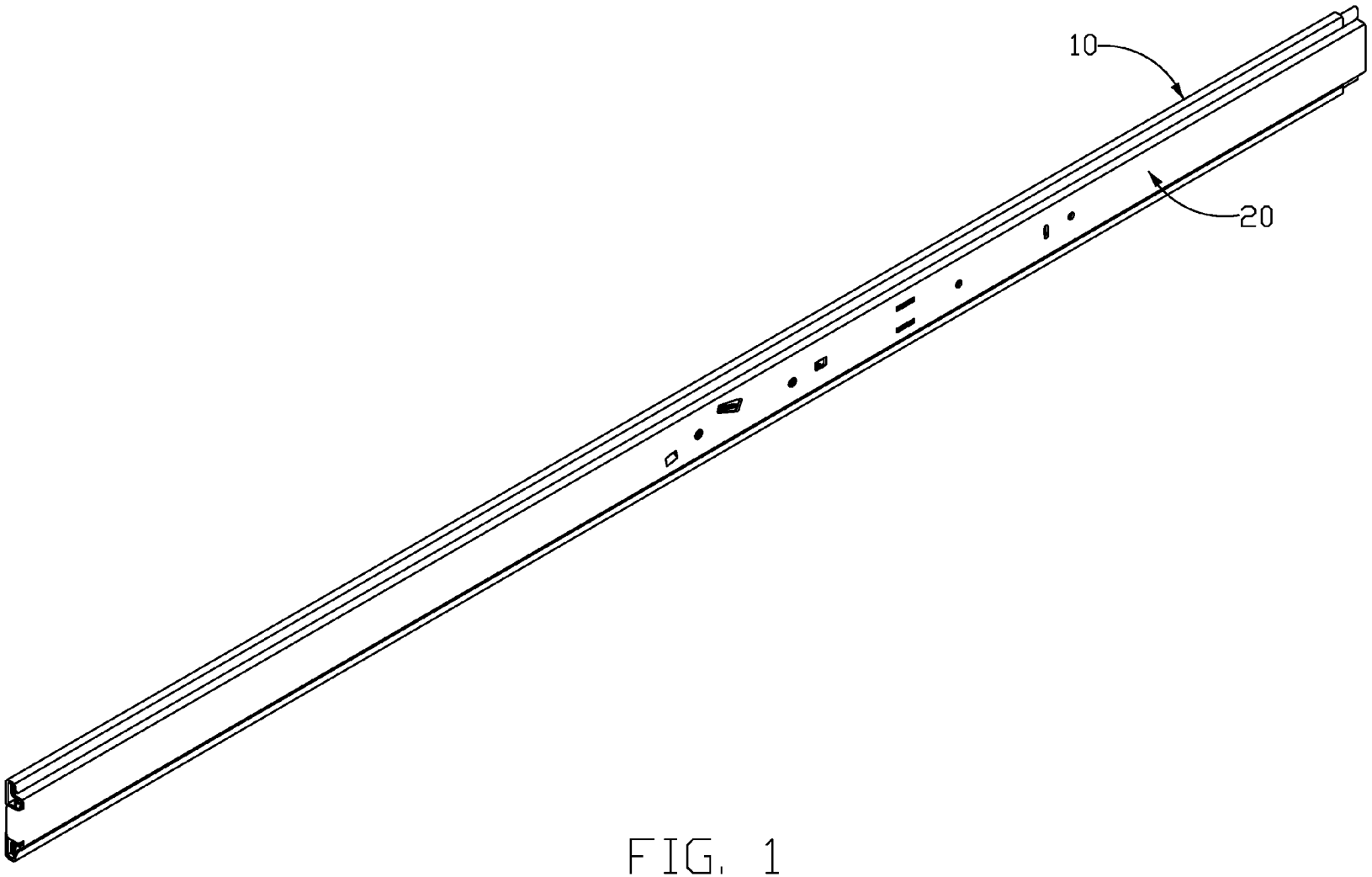
FIG. 1 is an assembled view of a slide rail assembly according to a preferred embodiment of the present invention.
Figure 2:
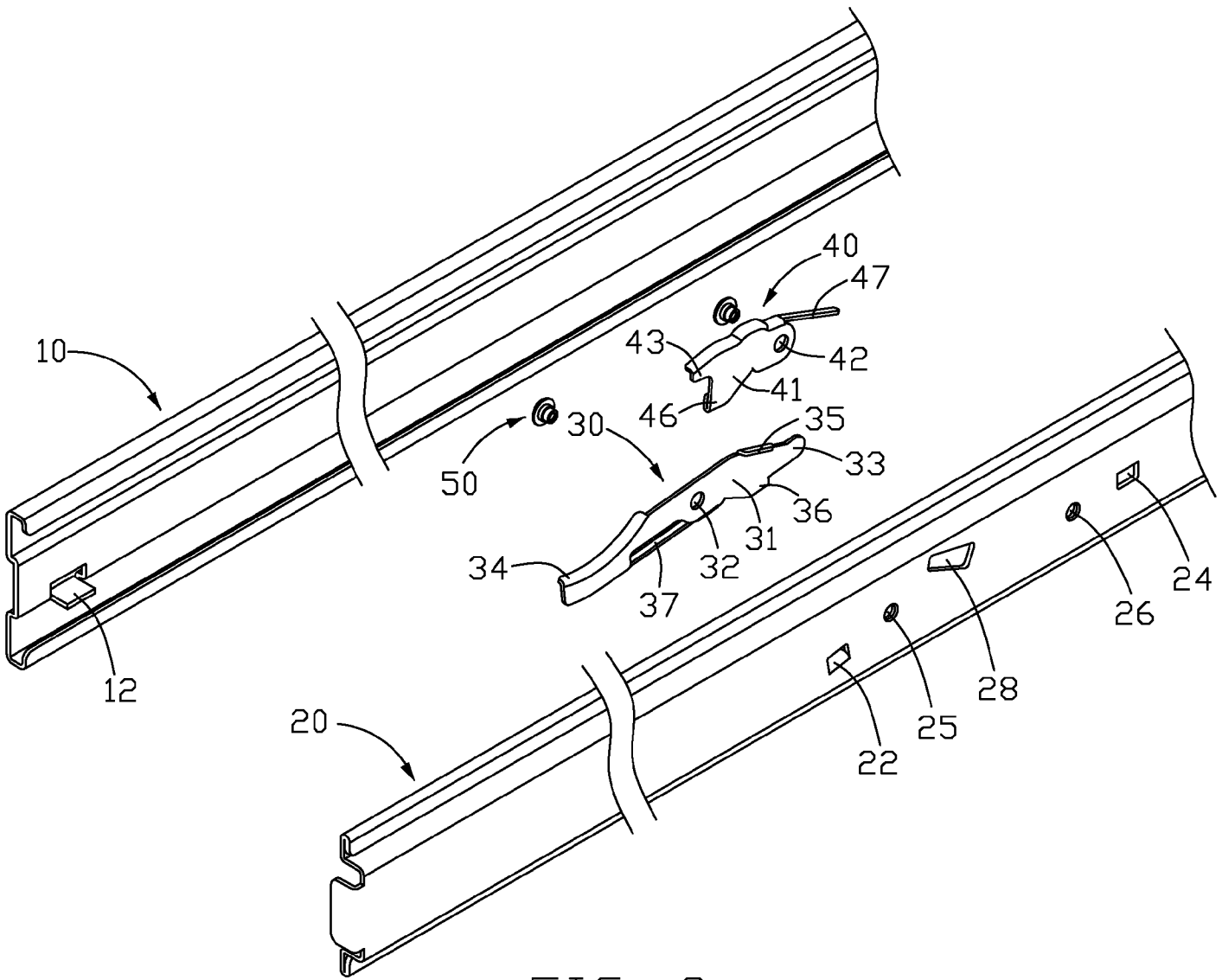
FIG. 2 is an exploded, isometric partial view of FIG. 1.

Referring to FIGS. 1 and 2, in an embodiment of the invention, a latch mechanism is provided for retaining a slide rail assembly which includes a first slide rail 10, and a second slide rail 20. The latch mechanism includes a first latch member 30, a second latch member 40, and two mounting members 50. The first slide rail 10 has a protrusion 12 extending from one end thereof. The mounting members 50 are preferably two rivets.

Figure 3:
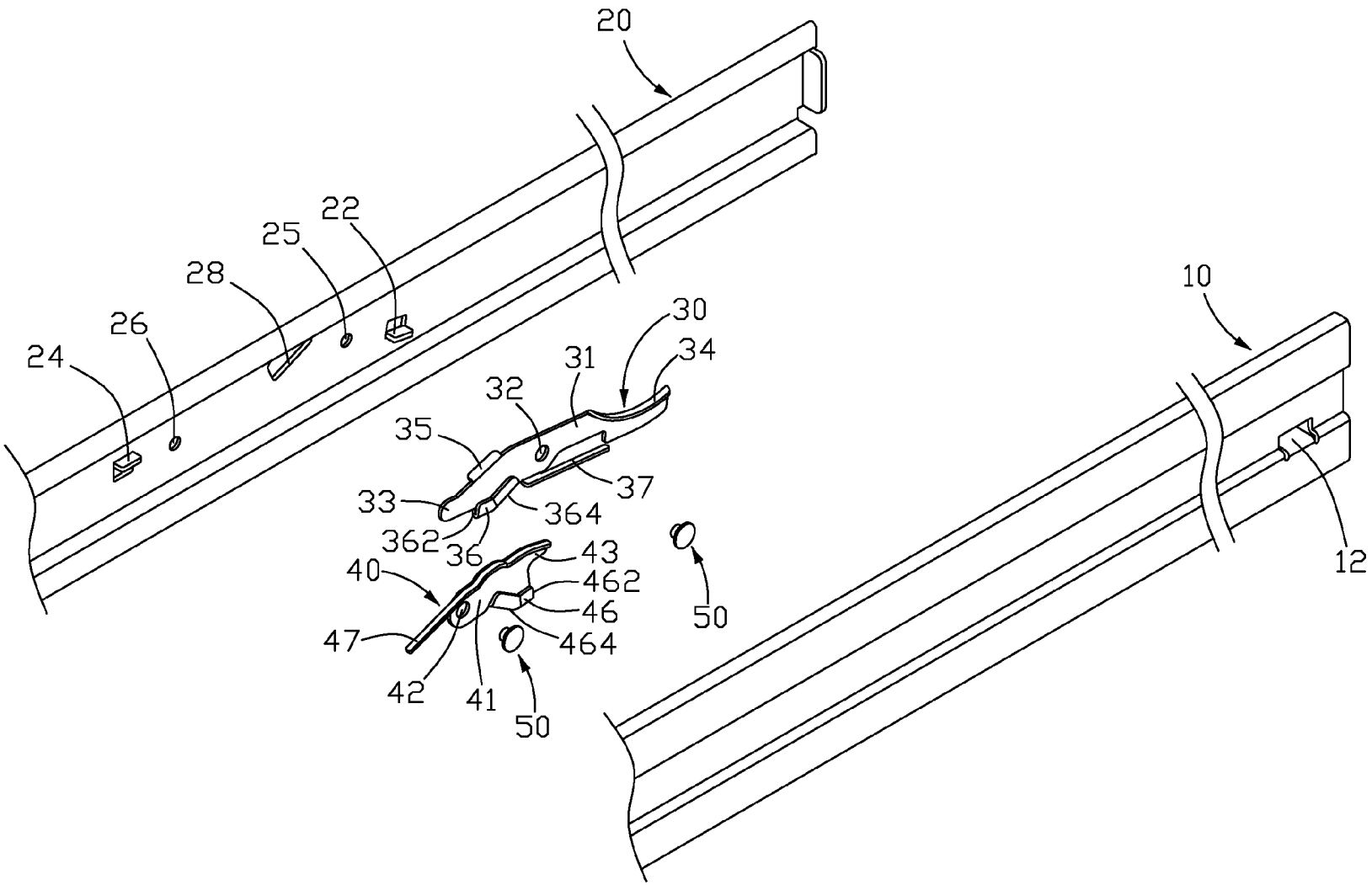
FIG. 3 is an inverted view of part of FIG. 2.

Referring also to FIG. 3, the second slide rail 20 includes a base wall, and two side walls extending from opposite sides of the base wall respectively. A first blocking tab 22 and a second blocking tab 24 extend from the base wall, spaced apart, to maintain a predetermined retaining position of the second slide rail 20 and the first slide rail 10. A first mounting hole 25, and a second mounting hole 26 are defined in the base wall between the first and second blocking tabs 22, 24. A slot 28 is defined in the base wall between the first and second mounting holes 25, 26.

The first latch member 30 includes a main body 31. A first pivoting hole 32 is defined in a middle portion of the main body 31. A driving portion 33 and an arc-shaped operating portion 34 extend from opposite ends of the main body 31 respectively. The driving portion 33 has an arc-shaped engaging surface at the free end thereof. A locating tab 35 extends toward the second slide rail 20 from one side of the main body in the vicinity of the driving portion 33. A first stop portion 36 extends downward from the other side of the main body 31 in the vicinity of the driving portion 33. The first stop portion 36 includes a first stop surface 362 adjacent to the driving portion 33, and a first inclined surface 364 opposite to the driving portion 33. A cantilevered first resilient portion 37 extends toward the operating portion 34 from the other side of the main body 31.

The second latch member 40 includes a main body 41. A second pivoting hole 42 is defined in one end of the main body 41. A driven portion 43 extends from the opposite end of the main body 41. The driven portion 43 has an arc-shaped engaging surface at the free end thereof. A second stop portion 46 extends downward from a base portion of the main body 41. The second stop portion 46 includes a second stop surface 462 adjacent to the driven portion 43, and a second inclined surface 464 opposite to the driven portion 43. A cantilevered second resilient portion 47 is bent toward the first slide rail 10 from an upper edge of the second latch member 40, and extends away from the main body of the second latch member 20.

Figure 4:
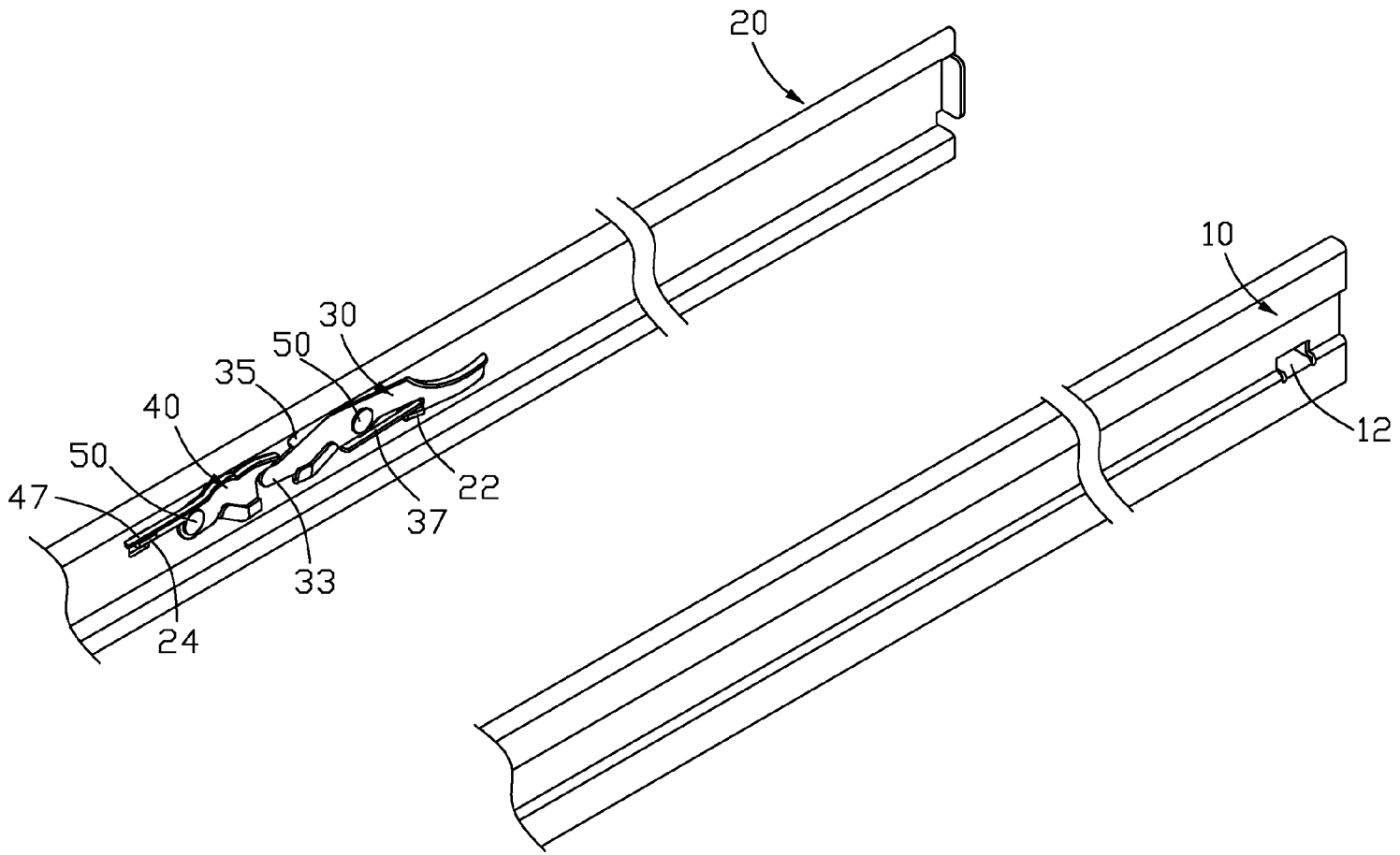
FIG. 4 is a partially assembled view of FIG. 3.

Referring also to FIG. 4, in assembly, the first and second latch members 30, 40 are pivotably attached to the second slide rail 20 via the mounting members 50 extending through the first and second pivoting holes 32, 42 to engage in the first and second mounting holes 25, 26 of the second slide rail 20 respectively. The free end of the first resilient portion 37 is engagable with the first blocking tab 22. The free end of the second resilient portion 47 is engagable with the second blocking tab 24. The locating tab 35 of the first latch member 30 is received in the slot 28 of the second slide rail 20, and engagable with an upside wall or a downside wall of the slot 28. The driving portion 33 is engagable with the driven portion 43.

Figure 5:
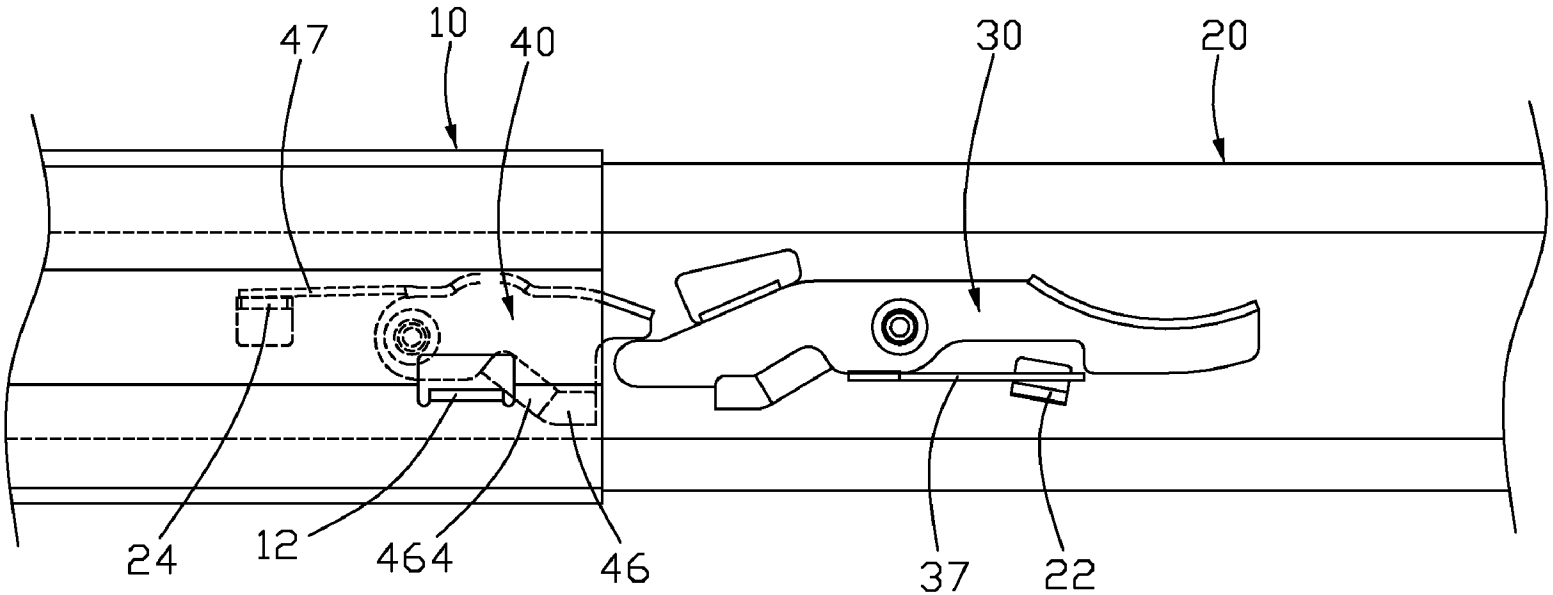
FIGS. 5-7 are lateral partial views of the slide rail assembly of FIG. 1 in three using states.
Figure 6:
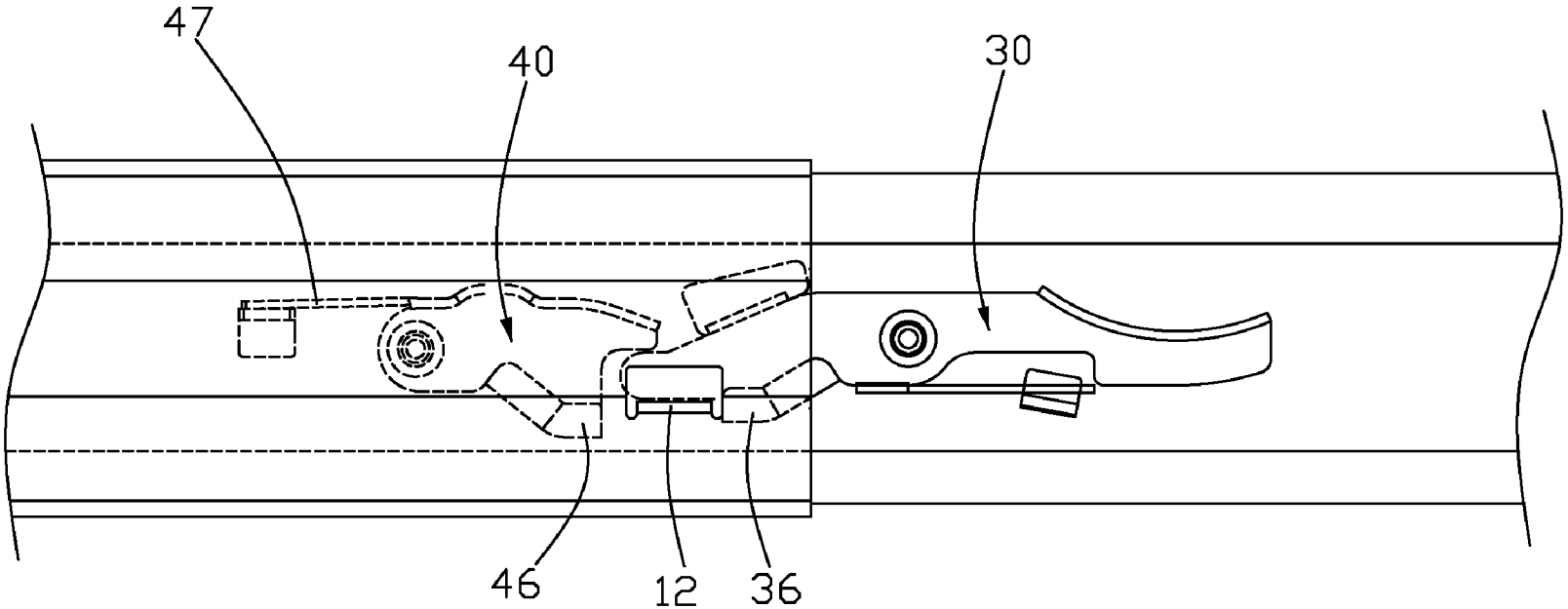

Referring also to FIG. 5, when pushing the second slide rail 20 to slide into the first slide rail 10, the second stop portion 46 of the second latch member 40 rides over the protrusion 12 of the first slide rail 10, thereby turning the second latch member 40 counter-clockwise to cause the second resilient portion 47 biasing against the second blocking tab 24 until the protrusion 12 of the first slide rail 10 slides into a space between the first and second stop portions 36, 46. The second resilient portion 47 rebounds to return the second latch member 40 to its original position, therefore the protrusion 12 of the first slide rail 10 is locked between the first and second stop surfaces 362, 462 to avoid the second slide rail 20 moving outward or inward relative to the first slide rail 10, as shown in FIG. 6. At this state, the driven portion 43 is located above the driving portion 33 and the locating tab 35 of the first latch member 30 abuts the downside wall of the slot 28.

Figure 7:
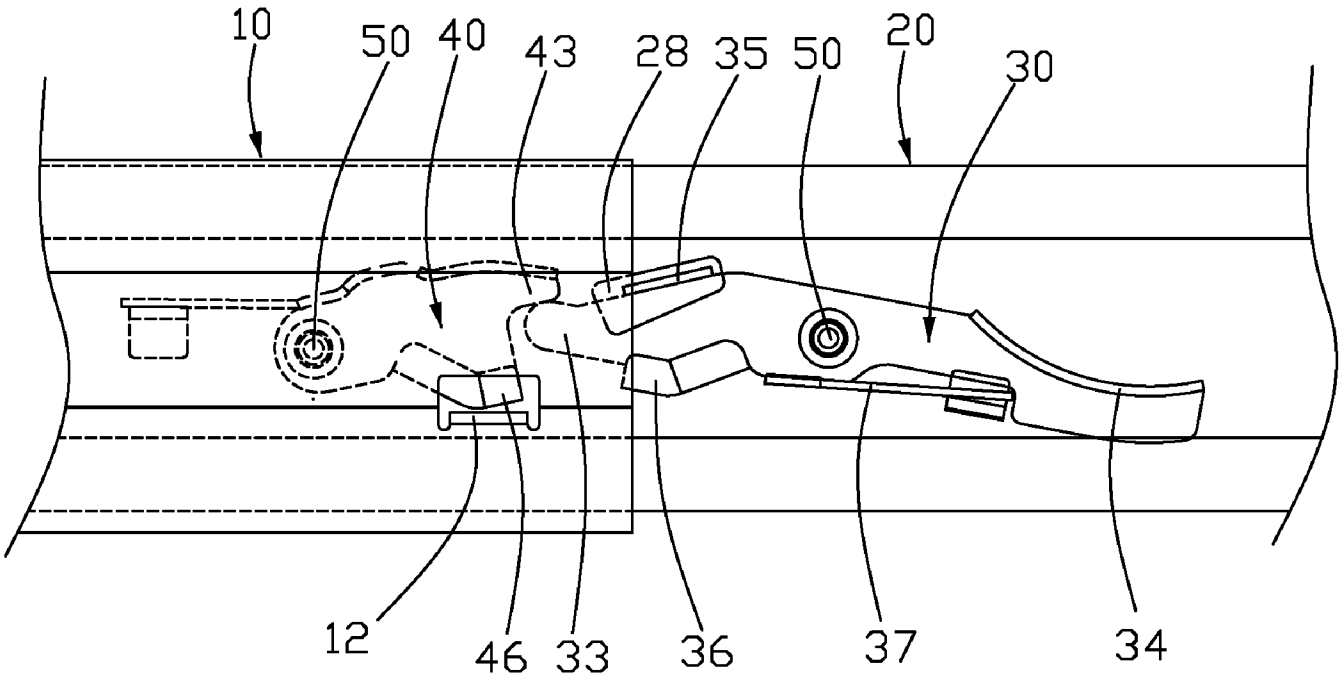

Referring also to FIG. 7, in releasing the second slide rail 20 from the first slide rail 10, press down the operating portion 34 of the first latch member 30 to bias the first latch member 30 clockwise. The driving portion 33 of the first latch member 30 urges the driven portion 43 of the second latch member 40 to bias the second latch member 40 counter-clockwise. The first and second stop surfaces 362, 462 disengage from the protrusion 12 of the first slide rail 10 which allows the second slide rail 20 freely movement relative to the first slide rail 10. The first resilient portion 37 of the first latch member 30 biases against the first blocking tab 22 and the locating tab 35 abuts against the upside wall of the slot 28 of the second slide rail 20.

When releasing the operating portion 34 of the second latch member 30, the first resilient portion 37 rebounds to return the first latch member 30 to its original position. The locating tab 35 of the first latch member 30 is capable of selectively engaging with the upside wall or the downside wall bounding the slot 28 of the second slide rail 20 for confining the first latch member 30. The first and second resilient portions may be integrated as a single resilient member arranged between the first and second latch members 30, 40 and the second slide rail 20 to return the first and second latch members 30, 40 to their original portions.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A slide rail assembly comprising:

a first slide rail;

a second slide rail;

a first latch member pivotably attached to the second slide rail, the first latch member comprising a driving portion extending from one end thereof, an operating portion extending from an opposite end thereof, and a first stop portion formed thereon in the vicinity of the driving portion;

a second latch member pivotably attached to the second slide rail, the second latch member comprising a second stop portion and a driven portion; and a protrusion extending from the first slide rail capable of being blocked between the first stop portion and the second stop portion to confine the second slide rail relative to the first slide rail;

wherein the operating portion of the first latch member is capable of being pressed to bias the first latch member such that the driving portion of the first latch member drives the driven portion of the second latch member to bias the second latch member to thereby release the protrusion of the first slide rail from the first and second stop portions;

wherein a locating tab extends from the first latch member, the second slide rail defines a slot for receiving the locating tab, the locating tab is engagable with two opposite sidewalls of the slot for confining the first latch member.

2. The slide rail assembly as described in claim 1, wherein the first latch member defines a first pivoting hole, the second latch member defines a second pivoting hole, two mounting members respectively extend through the first and second pivoting holes to pivotably attach the first and second latch members to the second slide rail.

3. The slide rail assembly as described in claim 1, wherein a first resilient portion is arranged on the first latch member for returning the first latch member to an original position after the first latch member is released.

4. The slide rail assembly as described in claim 3, wherein the first resilient portion integrally extends from a bottom portion of the first latch member toward the operating portion, a first blocking tab is configured on the second slide rail for deforming the first resilient portion when the operating portion of the first latch member is pressed.

5. The slide rail assembly as described in claim 1, wherein a second resilient portion is arranged on the second latch member for returning the second latch member to an original position after the second latch member is released.

6. The slide rail assembly as described in claim 5, wherein the second resilient portion extends from one end of the second latch member, a second blocking tab is configured on the second slide rail for deforming the second latch member when the second latch member is biased.

7. The slide rail assembly as described in claim 1, wherein the first stop portion comprises a first stop surface adjacent to the driving portion configured for engaging with the protrusion of the first slide rail, and a first inclined surface opposing to the driving portion configured for leading the first latch member to ride over the protrusion.

8. The slide rail assembly as described in claim 1, wherein the second stop portion comprises a second stop surface adjacent to the driven portion configured for engaging with the protrusion of the second slide rail, and a second inclined surface opposing to the driven portion configured for leading the second latch member to ride over the protrusion.

9. A slide rail assembly comprising:

a first slide rail having a protrusion arranged thereon;

a second slide rail slidably attached to the first slide rail;

a first latch member and a second latch member attached to the second slide rail and respectively pivotable around two parallel axes that are perpendicular to the second slide rail, the first latch member comprising a first stop portion, a driving portion, and an operating portion, the second latch member comprising a driven portion engagable with the driving portion and a second stop portion; and a resilient member arranged between the first and second latch members and the second slide rail to return the first and second latch members to their original portions;

wherein the second slide rail is slidable relative to the first slide rail to cause the protrusion to bias and ride over either one of the first and second stop portions to be restrained between the first and second stop portions;

wherein the operating portion of the first latch member is capable of being pressed to pivot the first latch member in one direction such that the driving portion of the first latch member urges the driven portion of the second latch member to pivot the second latch member in another direction to thereby release the protrusion of the first slide rail from the first and second stop portions, said another direction being reverse to the one direction;

wherein a locating tab extends from the first latch member, the second slide rail defines a slot for receiving the locating tab, the locating tab is engagable with two opposite sidewalls of the slot for confining the first latch member.

10. The slide rail assembly as described in claim 9, wherein the first latch member has a main body pivotably attached to the second rail, the driving portion and the operating portion extend from opposite ends of the main body.

11. The slide rail assembly as described in claim 10, wherein the driving portion has an arc-shaped engaging surface at a free end thereof configured for engaging with the driven portion.

12. The slide rail assembly as described in claim 10, wherein the first stop portion extends downward from one side of the main body in the vicinity of the driving portion.

13. The slide rail assembly as described in claim 12, wherein the first stop portion comprises a first stop surface adjacent to the driving portion, and a first inclined surface opposing to the driving portion configured for leading the first latch member to slide over the protrusion.

14. The slide rail assembly as claimed in claim 9, wherein the second latch member has a main body pivotably attached to the second rail, the driven portion extends from one end of the main body, the driven portion having an arc-shaped engaging surface at a free end thereof configured for engaging with the driving portion.

15. The slide rail assembly as claimed in claim 14, wherein the second stop portion extends downward from a bottom portion of the main body, the second stop portion includes a second stop surface adjacent to the driven portion, and a second inclined surface opposing to the driven portion configured for leading the second latch member to slide over the protrusion.

16. The slide rail assembly as claimed in claim 9, wherein the resilient member comprises a cantilevered resilient portion extending from the second latch member and abutting one portion of the second rail, the resilient portion being deformable when the second latch member is biased by the protrusion or the first latch member and reboundable to return the first and second latch members to their original portions when the second latch member is released.

17. The slide rail assembly as claimed in claim 16, wherein the resilient member further comprises another cantilevered resilient portion extending from the first latch member and abutting another portion of the second rail configured for cooperating with the one resilient portion to return the first latch member to its original portion.

* * * * *